US007159661B2

(12) United States Patent
Restarick et al.

(10) Patent No.: US 7,159,661 B2
(45) Date of Patent: Jan. 9, 2007

(54) MULTILATERAL COMPLETION SYSTEM UTILIZING AN ALTERNATE PASSAGE

(75) Inventors: Henry L. Restarick, Carrollton, TX (US); Jody R. McGlothen, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 173 days.

(21) Appl. No.: 10/725,140

(22) Filed: Dec. 1, 2003

(65) Prior Publication Data

US 2005/0115713 A1 Jun. 2, 2005

(51) Int. Cl.
*E21B 7/08* (2006.01)
*E21B 23/03* (2006.01)

(52) U.S. Cl. ..... 166/313; 166/50; 166/117.6

(58) Field of Classification Search ..... 166/313, 166/50, 117.6
See application file for complete search history.

(56) References Cited

U.S. PATENT DOCUMENTS

| | | | |
|---|---|---|---|
| 3,640,341 | A | 2/1972 | Braddick et al. |
| 4,646,836 | A | 3/1987 | Goodhart |
| 5,123,488 | A | 6/1992 | Jennings |
| 5,127,457 | A | 7/1992 | Stewart |
| 5,311,936 | A | 5/1994 | McNair et al. |
| 5,318,122 | A | 6/1994 | Murray et al. |
| 5,330,007 | A | 7/1994 | Collins et al. |
| 5,339,904 | A | 8/1994 | Jennings, Jr. et al. |
| 5,361,843 | A | 11/1994 | Shy et al. |
| 5,462,120 | A | 10/1995 | Gondouin |
| 5,484,383 | A | 1/1996 | Fitch et al. |
| 5,680,901 | A | 10/1997 | Gardes |
| 5,839,508 | A | 11/1998 | Tubel et al. |
| 5,868,210 | A | 2/1999 | Johnson et al. |
| 5,875,847 | A | 3/1999 | Forsyth |
| 5,878,815 | A | 3/1999 | Collins |
| 5,879,108 | A | 3/1999 | Haddad |
| 5,941,308 | A | 8/1999 | Malone et al. |
| 6,079,494 | A | 6/2000 | Longbottom et al. |
| 6,082,455 | A | 7/2000 | Pringle et al. |
| 6,089,320 | A | 7/2000 | LaGrange |
| 6,119,771 | A | 9/2000 | Gano et al. |
| 6,247,532 | B1 | 6/2001 | Ohmer |
| 6,253,846 | B1 | 7/2001 | Nazzai et al. |
| 6,279,651 | B1 | 8/2001 | Schwendemann et al. |
| 6,279,658 | B1 | 8/2001 | Donovan et al. |
| 6,354,375 | B1 | 3/2002 | Dewey |

(Continued)

FOREIGN PATENT DOCUMENTS

| | | | |
|---|---|---|---|
| CA | 2301966 | A1 | 9/2001 |

(Continued)

OTHER PUBLICATIONS

Search Report for United Kingdom application GB 042623.9.

(Continued)

*Primary Examiner*—David Bagnell
*Assistant Examiner*—Shane Bomar
(74) *Attorney, Agent, or Firm*—Marlin R. Smith

(57) ABSTRACT

A multilateral completion system utilizing an alternate passage. In a described embodiment, a wellbore junction includes a first passage extending from a first opposite end to a second opposite end of the wellbore junction. A window is formed through a sidewall of the wellbore junction and provides fluid communication between the first passage and an exterior of the wellbore junction. A second passage is in communication with the first passage on a first side of the window, and in communication with the first passage on a second side of the window.

102 Claims, 13 Drawing Sheets

U.S. PATENT DOCUMENTS

| | | | | |
|---|---|---|---|---|
| 6,422,312 | B1 | 7/2002 | Delatorre et al. | |
| 6,431,283 | B1 | 8/2002 | Dale | |
| 6,439,312 | B1 * | 8/2002 | Hess et al. | 166/313 |
| 6,464,011 | B1 | 10/2002 | Tubel | |
| 6,561,277 | B1 * | 5/2003 | Algeroy et al. | 166/373 |
| 6,615,920 | B1 | 9/2003 | Collins et al. | |
| 6,668,932 | B1 * | 12/2003 | Hess et al. | 166/313 |
| 2001/0017207 | A1 * | 8/2001 | Haheim | 166/265 |
| 2001/0025710 | A1 | 10/2001 | Ohmer et al. | |
| 2002/0023754 | A1 | 2/2002 | Buytaert | |
| 2002/0053437 | A1 | 5/2002 | Ohmer | |
| 2002/0088621 | A1 | 7/2002 | Hamilton | |
| 2002/0112857 | A1 | 8/2002 | Ohmer et al. | |
| 2003/0024700 | A1 | 2/2003 | Cavender | |
| 2003/0178196 | A1 * | 9/2003 | Smith | 166/313 |
| 2003/0221834 | A1 | 12/2003 | Hess et al. | |
| 2005/0167109 | A1 * | 8/2005 | Hepburn et al. | 166/313 |

FOREIGN PATENT DOCUMENTS

| | | |
|---|---|---|
| EP | 0945586 | 9/1999 |
| GB | 1165190 | 9/1969 |
| GB | 2 245 933 A | 7/2000 |
| WO | WO 01/71151 A1 | 9/2001 |

OTHER PUBLICATIONS

Office Action for U.S. Appl. No. 10/253,671, dated Nov. 17, 2004.
Haliburton Quick-Trip Valve sales presentation, undated.
U.S. Appl. No. 10/253,671, filed Sep. 24, 2002.
U.S. Appl. No. 10/253,324, filed Sep. 24, 2002.
U.S. Appl. No. 10/253,136, filed Sep. 24, 2002.
Search Report for United Kingdom Application No.: 0322266.8.
Office Action for U.S. Appl. No, 10/253,136, dated Jan. 5, 2004.
Office Action for U.S. Appl. No. 10/253,324, dated Mar. 30, 2004.
International Search Report for application no. PCT/US03/26791.
International Search Report for application no. PCT/US03/26360.
U.K. Search Report for application no. GB 0322266.8.
Office Action for U.S. Appl. No. 10/253,671, dated May 19, 2004.

* cited by examiner

MULTILATERAL COMPLETION SYSTEM UTILIZING AN ALTERNATE PASSAGE

BACKGROUND

The present invention relates generally to equipment utilized and operations performed in conjunction with a subterranean well and, in an embodiment described herein, more particularly provides a multilateral completion system utilizing an alternate passage.

In typical multilateral completion systems, a whipstock, milling guide or other type of deflector is set in a casing string in a main or parent wellbore to deflect a mill to form a window through a sidewall of the casing string. After the milling operation, the whipstock or another deflector may then be used to deflect drill bits and other tools through the window to form a branch or lateral wellbore. The whipstock or another deflector may then be used to deflect a liner string into the branch wellbore.

The liner string is cemented in the branch wellbore. An upper portion of the liner string in the main wellbore is then cut off and retrieved from the well. The whipstock or other deflector is then retrieved from the well to permit access to a lower portion of the main wellbore.

It will be appreciated that it would be beneficial to eliminate the time and expense involved in cutting off the upper portion of the liner string, retrieving it from the well, and retrieving the whipstock from the well. It would also be beneficial to provide improved isolation between the casing and liner strings and a formation surrounding the intersection between the main and branch wellbores.

SUMMARY

In carrying out the principles of the present invention, in accordance with an embodiment thereof, a wellbore junction is provided which includes at least one additional passage for flowing fluid through the wellbore junction around a deflector and/or upper end of a liner string secured in a main passage formed through the wellbore junction.

In one aspect of the invention, a wellbore junction for use in a subterranean well is provided. The wellbore junction includes a first passage extending from a first opposite end to a second opposite end of the wellbore junction. A window is formed through a sidewall of the wellbore junction. A second passage is in communication with the first passage on a first side of the window, and in communication with the first passage on a second side of the window.

In another aspect of the invention, a subterranean well system is provided. The system includes a wellbore junction positioned in a first wellbore at an intersection between the first wellbore and a second wellbore. The wellbore junction has first and second passages formed therein, the first passage extending through the wellbore junction. A liner string extends outwardly through a window formed through a sidewall of the wellbore junction. An end of the liner string is secured in the first passage, with the liner string extending into the second wellbore. The second passage provides fluid communication between the first passage on a first side of the liner string end and the first passage on a second side of the liner string end.

In yet another aspect of the invention, a method of completing a well having at least first and second intersecting wellbores is provided. The method includes the steps of: installing a casing string in the first wellbore, including interconnecting a wellbore junction in the casing string; securing a deflector assembly in a first passage of the wellbore junction; and flowing fluid through a second passage of the wellbore junction between the casing string on a first side of the wellbore junction and the casing string on a second side of the wellbore junction, without retrieving the deflector assembly from the first passage.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
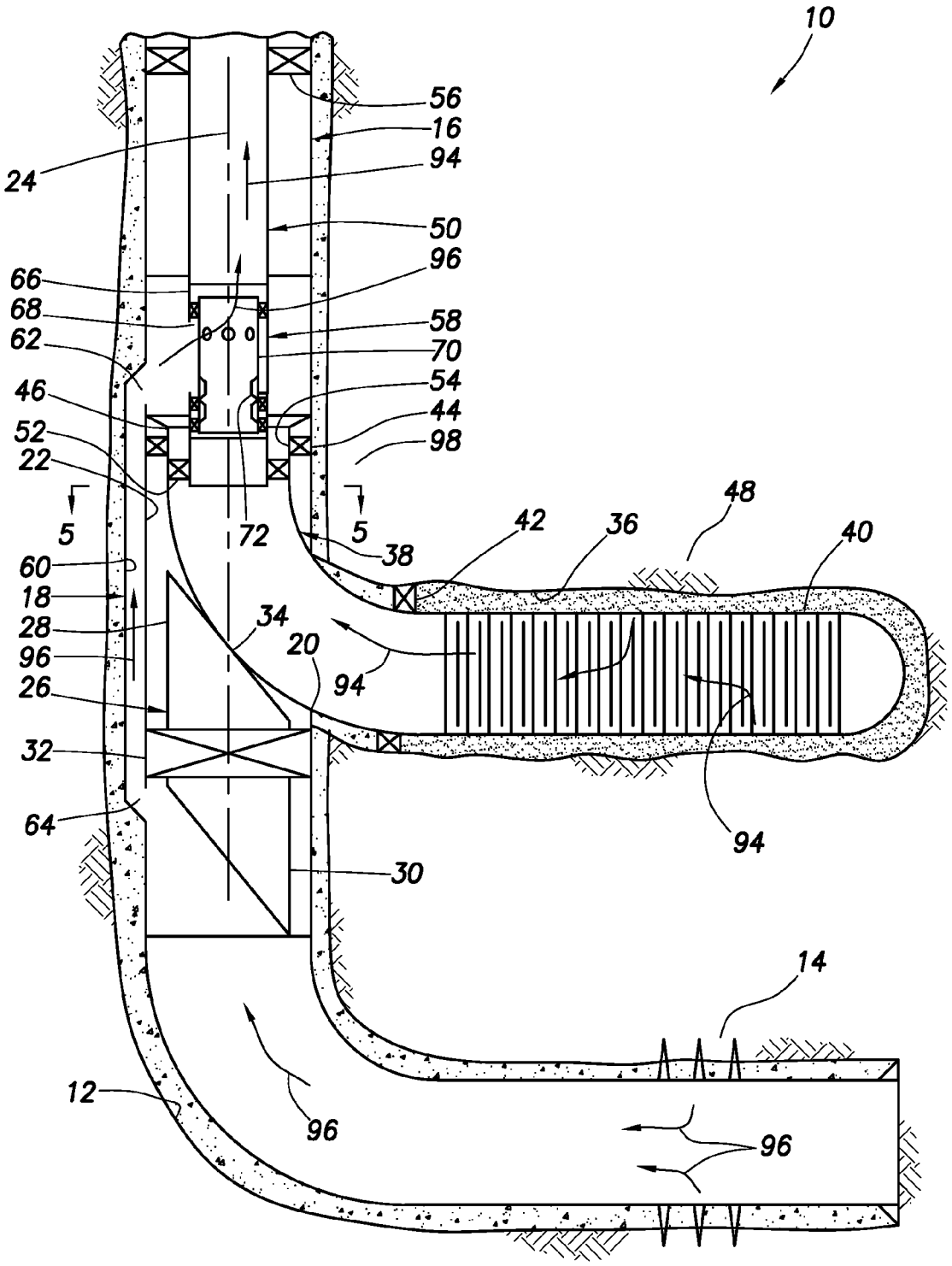
FIG. 1 is a schematic partially cross-sectional view of a first subterranean well system embodying principles of the present invention.

Representatively illustrated in FIG. 1 is a subterranean well system 10 which embodies principles of the present invention. In the following description of the well system 10 and other apparatus and methods described herein, directional terms, such as "above", "below", "upper", "lower", etc., are used for convenience in referring to the accompanying drawings. The term "above" means relatively closer to the earth's surface along a wellbore, while the term "below" means relatively farther away from the earth's surface along a wellbore. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, a main or parent wellbore 12 is drilled to intersect a formation or zone 14. A casing string 16 is installed in the main wellbore 12 and is cemented therein. Note that the main wellbore 12 may extend continuously to the earth's surface, or it may be a branch of another wellbore, it may intersect other wellbores, etc. In addition, the term "casing string" is used herein to indicate not only a tubular string made up of segments known to those skilled in the art as "casing," but also other types of tubular strings, such as those made up of material known as "liner" or "tubing," and continuous, expandable, and/or non-metallic tubular strings, etc.

The casing string 16 has a wellbore junction 18 interconnected therein. In one important feature of the invention, the wellbore junction 18 has multiple passages formed therein, which are described in more detail below. The wellbore junction 18 also has a window 20 formed through a sidewall of the junction. The window 20 may be preformed in the wellbore junction 18 prior to its installation in the wellbore 12, in which case it may be temporarily covered with a shield during cementing of the casing string 16 in the wellbore, or the window may be cut through the junction sidewall after the casing string is cemented in the wellbore. Any method of forming the window 20 may be used in keeping with the principles of the invention.

The zone 14 may be completed after the casing string 16 is cemented in the wellbore 12. For example, the casing string 16 may be perforated as depicted in FIG. 1, and additional equipment, such as packers, valves, screens, etc. (not shown) may be installed in the casing string. The zone 14 could be stimulated, gravel packed, completed open hole, etc.

A passage 22 formed completely through the wellbore junction 18 facilitates completion of the zone 14 by permitting packers, screens, stimulation equipment, etc. to pass therethrough unimpeded. Note that the passage 22 is aligned with a longitudinal axis 24 of the casing string 16, thereby providing convenient, and preferably full bore, access to the casing string below the wellbore junction 18.

After completing the zone 14, a deflector assembly 26 is installed and secured in the passage 22. The deflector assembly 26 includes an upper deflector 28, a lower deflector 30 and an anchor 32, such as a packer or latch. The deflector assembly 26 is rotationally oriented in the passage 22 so that an upper inclined face 34 of the upper deflector 28 is directed toward a desired direction for forming a lateral or branch wellbore 36. Preferably, the anchor 32 is a latch, and this orientation is due to engagement of the latch with an orienting latch profile (not shown in FIG. 1, but see profile 234 in FIG. 17) formed in the passage 22. If the anchor 32 is a packer, then this orientation may be accomplished using a gyroscope or another direction indicating or orienting device.

The upper deflector 28 is now used to deflect cutting tools, such mills and/or drills to form the branch wellbore 36. If the window 20 is preformed in the sidewall of the wellbore junction 18, then it may not be necessary to mill through the junction sidewall. Note that the branch wellbore 36 could be drilled prior to installing the wellbore junction 18, in keeping with the principles of the invention.

A liner string 38 is installed in the branch wellbore 36 by deflecting its lower end off of the upper deflector 28 and into the branch wellbore. The term "liner string" is used herein to indicate a tubular string made up of segments known to those skilled in the art as "liner," as well as other types of tubular strings, such as those made up of material known as "casing" or "tubing," and continuous, expandable, and/or non-metallic tubular strings, etc.

As depicted in FIG. 1, the liner string 38 includes a screen 40, an inflatable packer 42 and a liner hanger packer 44. The liner hanger packer 44 is positioned at an upper end 46 of the liner string 38, and is set in the passage 22 above the window 20. Other methods of securing and sealing the upper end 46 of the liner string 38 may be used in keeping with the principles of the invention.

The liner string 38 may be cemented in the branch wellbore 36, or it may be left uncemented. As depicted in FIG. 1, a formation or zone 48 intersected by the branch wellbore 36 may be completed by gravel packing about the screen 40 below the packer 42 set in the branch wellbore. Of course, the zone 48 may be completed using any other methods, such as by cementing the liner string 38 through the zone and then perforating the liner string, stimulating the zone, installing sand control equipment inside the liner string, etc., in keeping with the principles of the invention.

A tubular string 50, such as a production tubing string, is then installed in the well. A lower end of the tubular string 50 is engaged with the upper end 46 of the liner string 38, for example, by inserting seals 52 carried on the lower end of the tubular string into a seal bore 54 associated with the liner hanger packer 44. In this manner, sealed fluid communication is established between the interior of the tubular string 50 and the interior of the liner string 38.

The tubular string 50 includes a packer 56 and an access and flow control device 58. The packer 56 is set in the casing string 16, in order to secure the tubular string 50 in position and seal an annulus between the tubular string and the casing string, after the seals 52 are inserted into the seal bore 54. However, any means of securing and sealing the tubular string 50 may be used in keeping with the principles of the invention.

In another important feature of the invention, the access and flow control device 58 provides fluid communication and access between the interior of the tubular string 50 and the zone 14 below the wellbore junction 18 via a second, or alternate, passage 60 formed in the wellbore junction. The passage 60 extends between two fluid paths 62, 64 which provide fluid communication between the passages 22, 60. The upper fluid path 62 connects the passages 22, 60 above the upper end 46 of the liner string 38, the window 20 and the deflector assembly 26. The lower fluid path 64 connects the passages 22, 60 below the upper end 46 of the liner string 38, the window 20 and the deflector assembly 26.

In this manner, the tubular string 50 can be in fluid communication with the zone 14 without having to cut off or retrieve the upper end 46 of the liner string 38, and without having to retrieve the deflector assembly 26 from the casing string 16. In addition, access is available to the zone 14, for example, to perform remedial operations therein, via the access and flow control device 58.

As depicted in FIG. 1, the access and flow control device 58 includes an outer housing 66 having a window 68 formed through a sidewall thereof. The window 68 is rotationally oriented to face toward the fluid path 62. This orientation may be achieved, for example, by engaging a latch carried on the tubular string 50 with an orienting latch profile formed in the upper end 46 of the liner string 38.

A sleeve 70 installed in the housing 66 permits fluid communication between the interior of the tubular string 50 and the fluid path 62. The sleeve 70 may be retrieved or shifted within the housing 66 to permit access between the tubular string 50 and the passage 60, as described more fully below. A latch profile 72 formed in the sleeve 70 may be used to shift the sleeve within the housing 66, or to retrieve the sleeve from within the tubular string 50.

Figure 1A:
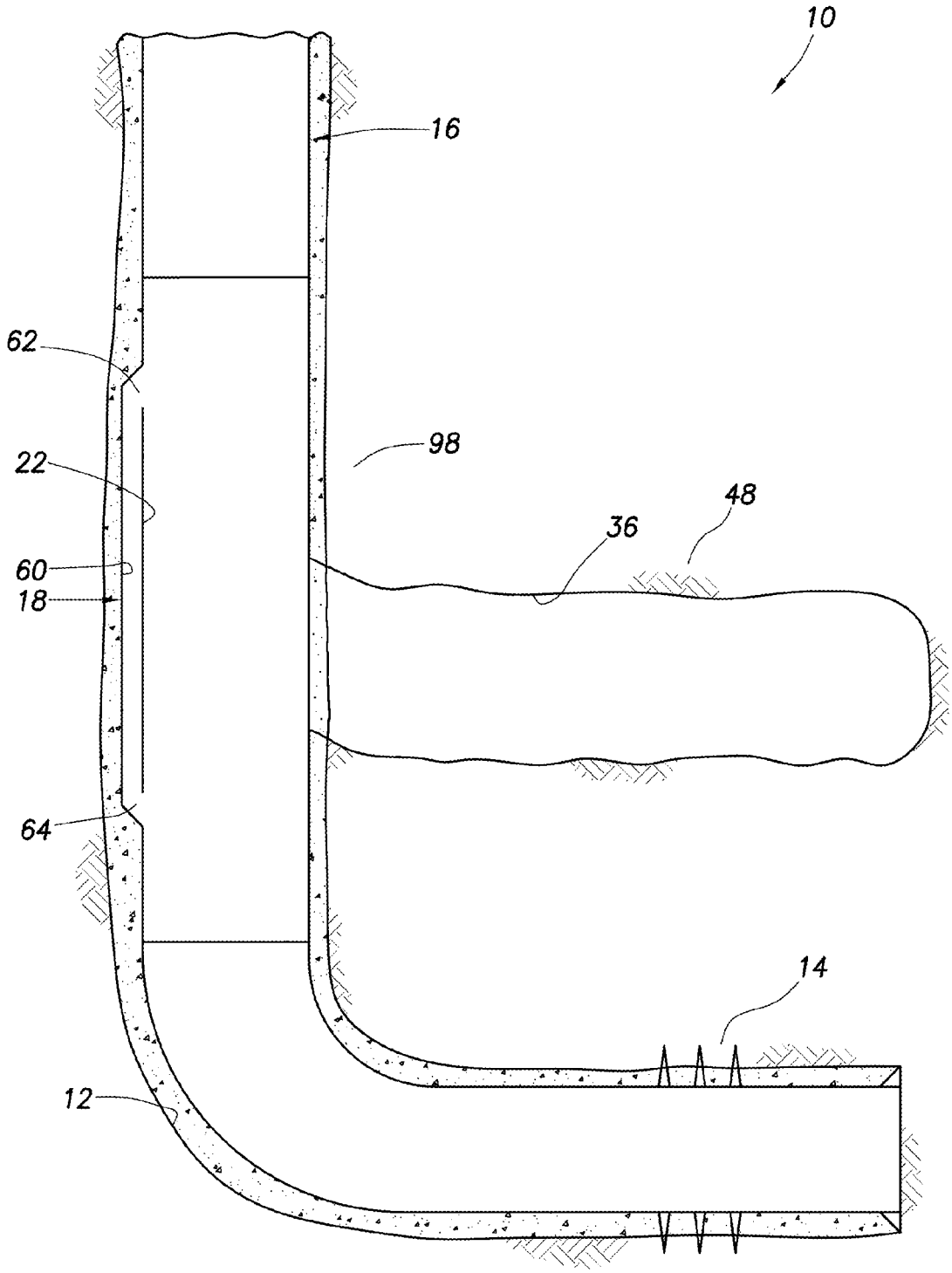
FIG. 1A is a schematic cross-sectional view of the first subterranean well system prior to installation of a deflector assembly, liner string, and access and flow control device.

FIG. 1A depicts the well system 10 prior to installation of the deflector assembly 26, liner string 38, and access and flow control device 58 in the wellbore junction 18.

Figure 2:
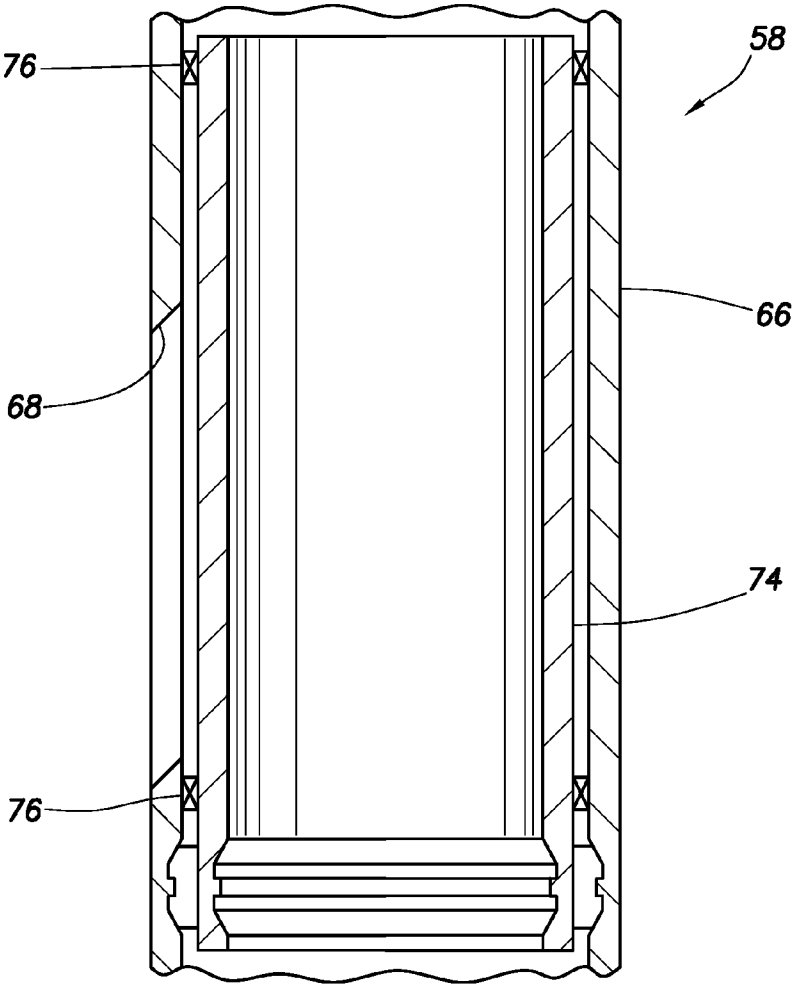
FIG. 2 is an enlarged scale cross-sectional view of a flow and access control device which may be used in the first system.

Referring additionally now to FIG. 2, an enlarged view of the access and flow control device 58 is schematically and representatively illustrated. In this view, an alternate sleeve 74 is shown replacing the sleeve 70 shown in FIG. 1. When positioned as depicted in FIG. 2, the sleeve 74 prevents access to the passage 60 through the window 68 and, due to engagement of seals 76 on either side of the window 68, also prevents fluid communication between the interior of the tubular string 50 and the passage 60. However, the sleeve 74 may be shifted in the housing 66, if desired, to uncover the window 68 and provide access and fluid communication therethrough.

Figure 3:
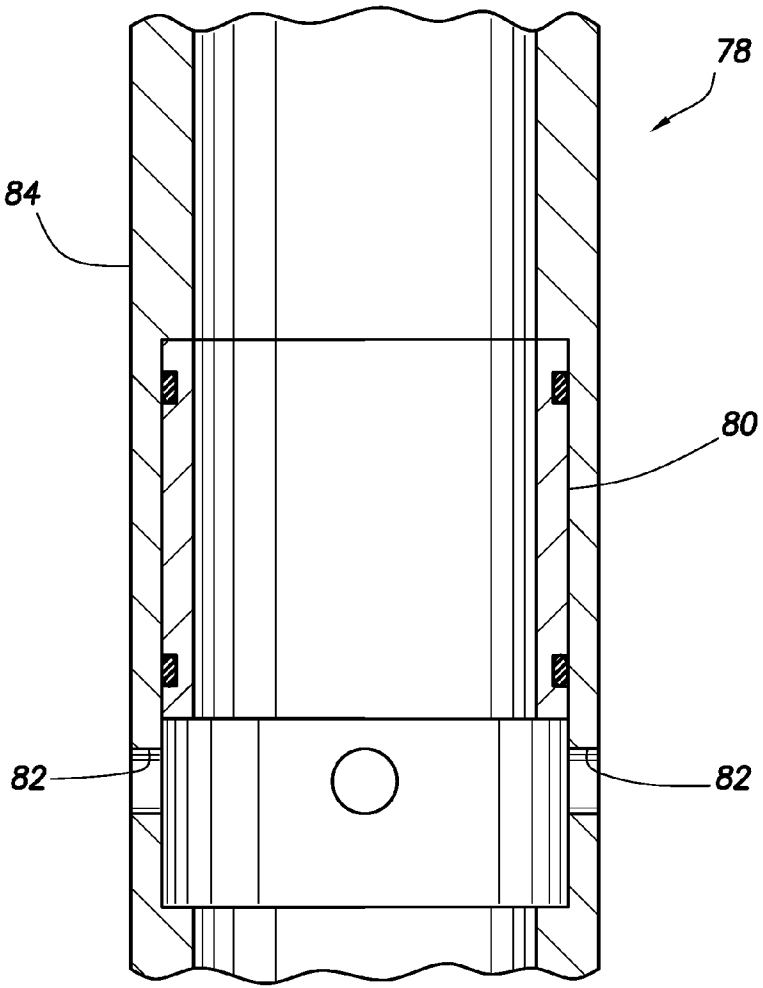
FIG. 3 is an enlarged scale cross-sectional view of a flow control device which may be used in the first system.

Referring additionally now to FIG. 3, a flow control device 78 which may be substituted for the device 58 in the tubular string 50 is representatively illustrated. The device 78 may be used if access to the passage 60 is not desired, but control of fluid flow between the interior of the tubular string 50 and the passage 60 is desired. The flow control device 78 is similar to a conventional sliding sleeve valve in that it includes a sleeve 80 which is shifted to either permit or prevent flow through openings 82 formed through a sidewall of a tubular outer housing 84.

Figure 4:
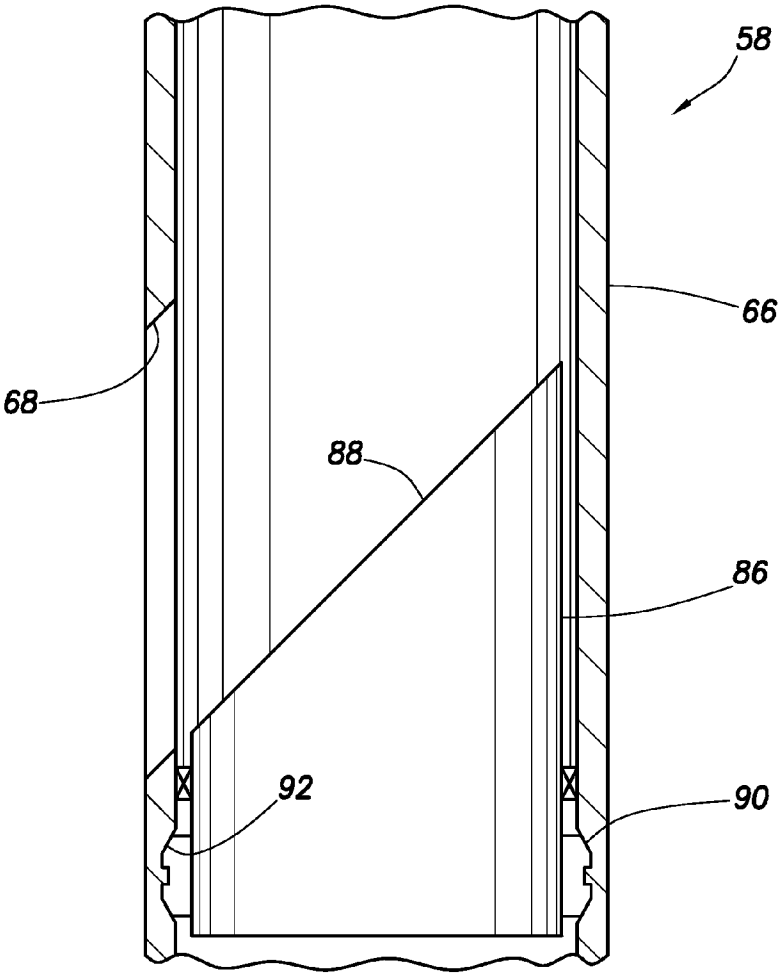
FIG. 4 is an enlarged scale partially cross-sectional view of a deflector which may be used in the first system.

Referring additionally now to FIG. 4, the access and flow control device 58 is again illustrated apart from the remainder of the system 10. In this view, the sleeve 70 has been retrieved from the housing 66 and replaced with a deflector 86. An upper inclined face 88 of the deflector 86 is oriented toward the window 68 by engagement of a latch go carried on the deflector 86 with an orienting latch profile 92 formed in the housing 66. In this manner, well tools may be deflected off of the face 88 from the interior of the tubular string 50 and into the passage 60 when access to the casing string 16 below the wellbore junction 18 is desired.

It may now be fully appreciated that the system 10 depicted in FIG. 1 provides many advantages over prior multilateral completion systems. The wellbore junction 18 permits fluid (indicated by arrows 94) to flow from the zone 48 into the liner string 38 and then into the tubular string 50 for production to the surface, while also permitting fluid (indicated by arrows 96) to flow from the zone 14 into the tubular string for production to the surface, without requiring the deflector assembly 26 or upper end 46 of the liner string to be retrieved from the well. In addition, the device 58 permits the fluid flow 96 to be controlled, as well as permitting access to the casing string 16 below the wellbore junction 18 via the passage 6o. Furthermore, since the upper end 46 of the liner string 38 is sealed and secured in the passage 22 of the wellbore junction 18, a very desirable completion known to those skilled in the art as a "Level 6" completion is achieved, providing superior isolation between the interior of the junction and a formation 98 surrounding the intersection between the wellbores 12, 36.

Note that it is not necessary in keeping with the principles of the invention for the fluids 94, 96, or either of them, to be produced from the well. Either or both of the fluids 94, 96 could instead be injected into the well.

Figure 5:
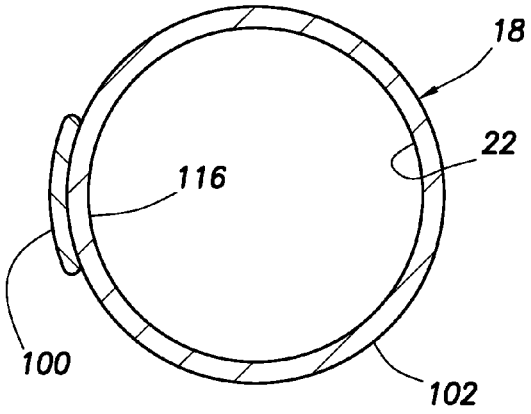
FIG. 5 is a cross-sectional view of a wellbore junction which may be used in the first system, the wellbore junction being illustrated in a first unexpanded configuration.

Referring additionally now to FIG. 5, a cross-sectional view of the wellbore junction 18, taken along line 5—5 of FIG. 1, is representatively illustrated. This view depicts the wellbore junction 18 prior to installation in the wellbore 12.

Figure 7:
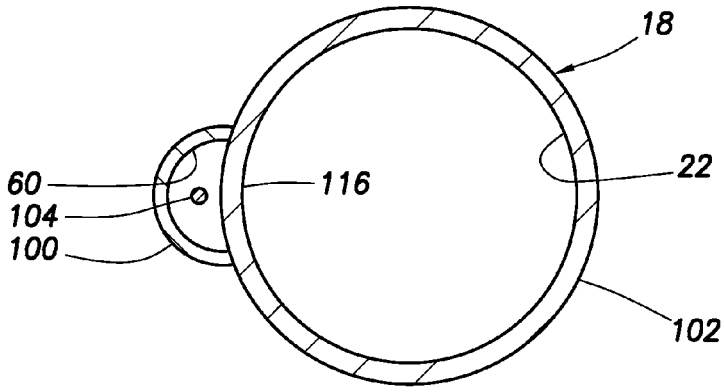
FIG. 7 is a cross-sectional view of the wellbore junction illustrated in a first expanded configuration.

In order to provide for convenient installation of the wellbore junction 18, the second or alternate passage 60 is in an unexpanded configuration. After being positioned and appropriately oriented in the wellbore 12, the passage 60 is expanded, as depicted in FIG. 7. The passage 60 may be expanded, for example, by applying pressure to the passage to inflate it, or by mechanically swaging the passage outward.

Figure 18:
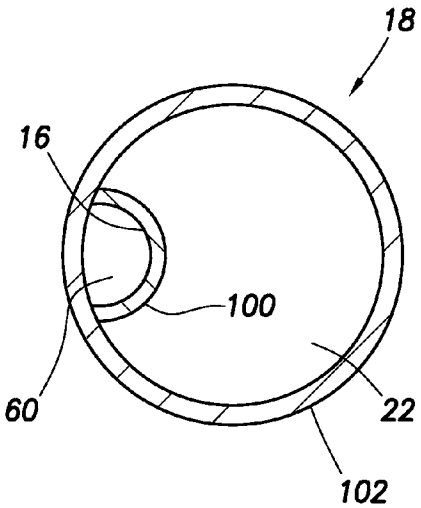
FIG. 18 is a cross-sectional view of an alternate configuration of the wellbore junction.

Note that, as depicted in FIGS. 5 and 7, the passage 60 is formed within a semicircular-shaped housing 100 attached externally (such as by welding) to a tubular cylindrical housing 102. The passage 60 is, thus, formed with a D-shaped cross-section. The housing 102 may be formed from a conventional casing material. Of course, the wellbore junction 18 may be otherwise constructed, without departing from the principles of the invention. Such an alternate construction is depicted in FIG. 18 and described below.

Figure 6:
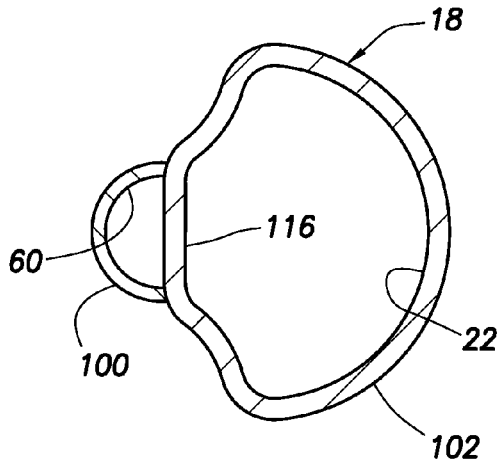
FIG. 6 is a cross-sectional view of the wellbore junction illustrated in a second unexpanded configuration.

In FIG. 6, an alternative initial unexpanded configuration of the wellbore junction 18 is representatively illustrated. In this configuration, the housing 102 is instead in a compressed or unexpanded configuration when the wellbore junction 18 is installed. After installation, the housing 102 is expanded to the configuration shown in FIG. 7 by, for example, applying pressure to inflate the housing, or mechanically swaging the housing outward. Of course, both of the housings 100, 102 could be expanded downhole, and it is not necessary for either of the housings to be expanded, in keeping with the principles of the invention.

In FIG. 7 it may be seen that the passage 60 provides access therethrough for well tools, etc. As depicted in FIG. 7, a wireline 104 is used to convey a well tool (not shown) through the passage 60.

Figure 8:
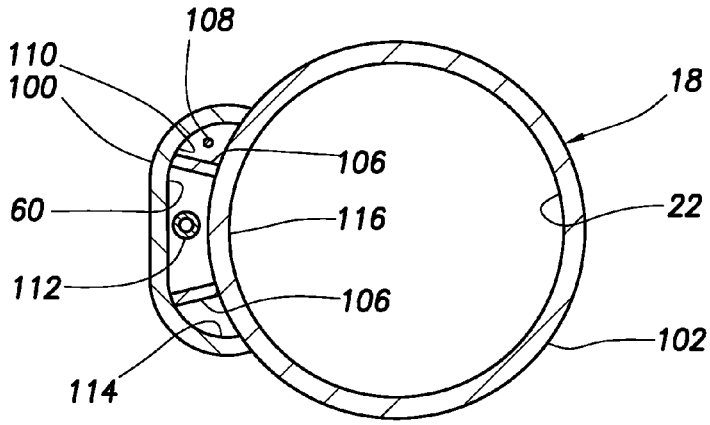
FIG. 8 is a cross-sectional view of the wellbore junction illustrated in a second expanded configuration.

In FIG. 8, another alternate configuration of the wellbore junction 18 is representatively illustrated. In this configuration, the housing 100 is somewhat laterally elongated, providing additional area in the passage 60. Support ribs 106 may be included between the housings 100, 102 to strengthen the housing 100, to divide the passage 60 into multiple separate passages, to prevent well tools, wirelines, etc. from becoming lodged in corners of the passage 60, etc. As depicted in FIG. 8, a control line 108 (such as a fiber optic, electrical or hydraulic line) is installed in a separate passage 110, while a coiled tubing string 112 is conveyed through the passage 60. Yet another passage 114 is available for providing fluid communication with other zones intersected by the well.

Note that in each of the configurations illustrated in FIGS. 5–8, the passages 22, 60 are separated by only a single layer of material 116 in the housing 102 sidewall. For compactness and efficient use of available area in the wellbore 12, this is preferred over other configurations which would utilize multiple layers of material to separate the passages 22, 60, such as by using multiple tubular members to form the passages. However, multiple attached tubular members could be used in keeping with the principles of the invention.

It may be desirable in some instances to initially prevent fluid communication between the passages 22, 60, or to prevent flow through the passage 60. For example, if stimulation or gravel packing operations are to be performed in the branch wellbore 36, fluid communication between the passages 22, 60 could possibly hinder or complicate these operations. Therefore, the system lo could be configured so that fluid communication between the passages 22, 60, or fluid flow through the passage 60, is provided at some time after the wellbore junction 18 is installed in the well.

Figure 9:
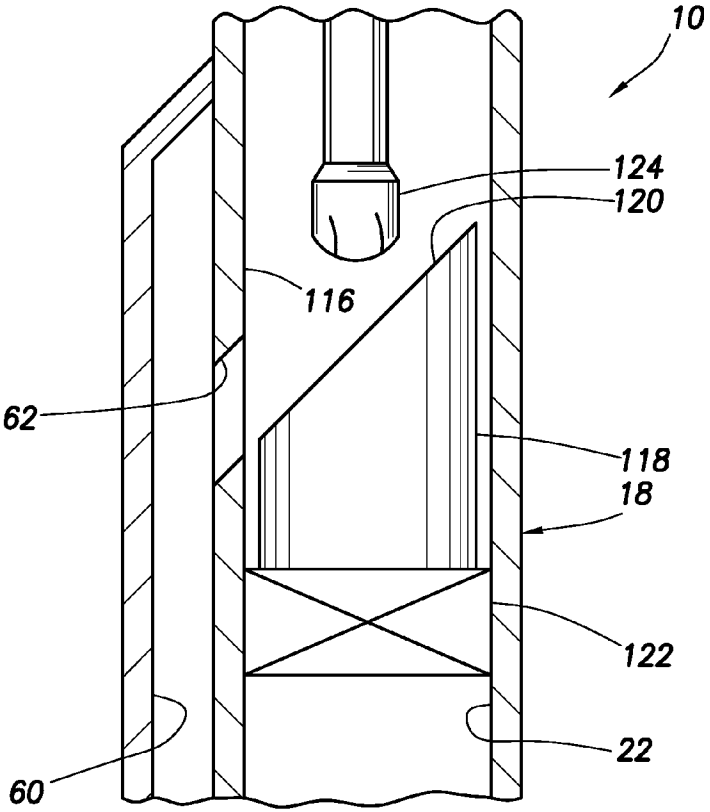
FIG. 9 is a schematic partially cross-sectional view of a first method of providing for fluid flow through a laterally offset passage of the wellbore junction.

Referring additionally now to FIG. 9, a method whereby fluid communication between the passages 22, 60 may be provided after installation of the wellbore junction 18 is representatively illustrated. As depicted in FIG. 9, a deflector 118 is secured in the passage 22 and rotationally oriented so that an inclined upper face 120 of the deflector faces toward the passage 60. The deflector 118 may be secured by means of an anchoring device 122, such as a packer or latch.

If the anchoring device 122 is a latch, then the rotational orientation may be accomplished by engaging the latch with an orienting profile formed in the passage 22. If the anchoring device 122 is a packer, then the rotational orientation may be accomplished by use of a gyroscope or other orienting device.

After the deflector 118 is oriented and secured in the passage 22, a cutting device 124, such as a mill, is used to cut through the layer of material 116 separating the passages 22, 60 to thereby form the fluid path 62 between the passages. The fluid path 62 may then provide access and fluid communication between the passages 22, 60.

Figure 10:
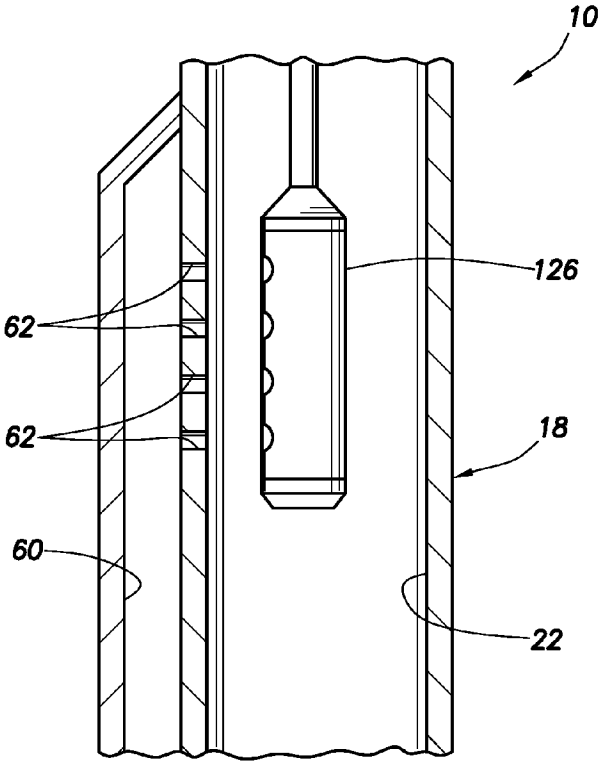
FIG. 10 is a schematic partially cross-sectional view of a second method of providing for fluid flow through the laterally offset passage of the wellbore junction.

Referring additionally now to FIG. 10, another method of providing fluid communication between the passages 22, 60 in the system lo is representatively illustrated. In this method, a perforating gun 126 is conveyed into the passage 22 and is rotationally oriented so that shaped charges (not shown) of the gun face toward the passage 60. The charges are detonated to form one or more fluid paths 62 (otherwise known as perforations) between the passages 22, 60.

Figure 11:
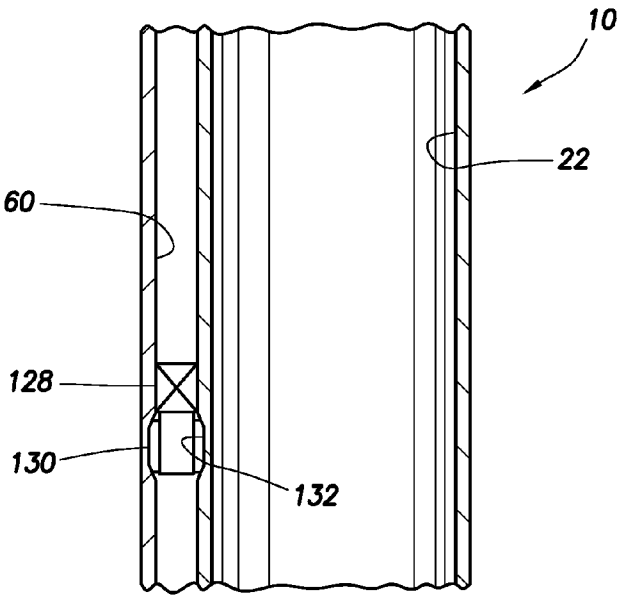
FIG. 11 is a schematic partially cross-sectional view of a third method of providing for fluid flow through the laterally offset passage of the wellbore junction.

Referring additionally now to FIG. 11, a method of selectively preventing fluid flow through the passage 60 in the system lo is representatively illustrated. In this method, fluid flow through the passage 60 is initially prevented, instead of specifically preventing fluid communication between the passages 22, 60. This may be useful in the operations discussed above (such as stimulation and gravel packing operations) or in other situations in which it is desired to selectively prevent fluid flow through the passage 60.

As depicted in FIG. 11, a plug 128 is set in the passage 60 to prevent fluid flow through the passage. The plug 128 may, for example, include a latch 130 which engages a profile 132 formed internally in the passage 60. Of course, other means of securing the plug 128, such as slips, may be used in keeping with the principles of the invention.

Figure 12:
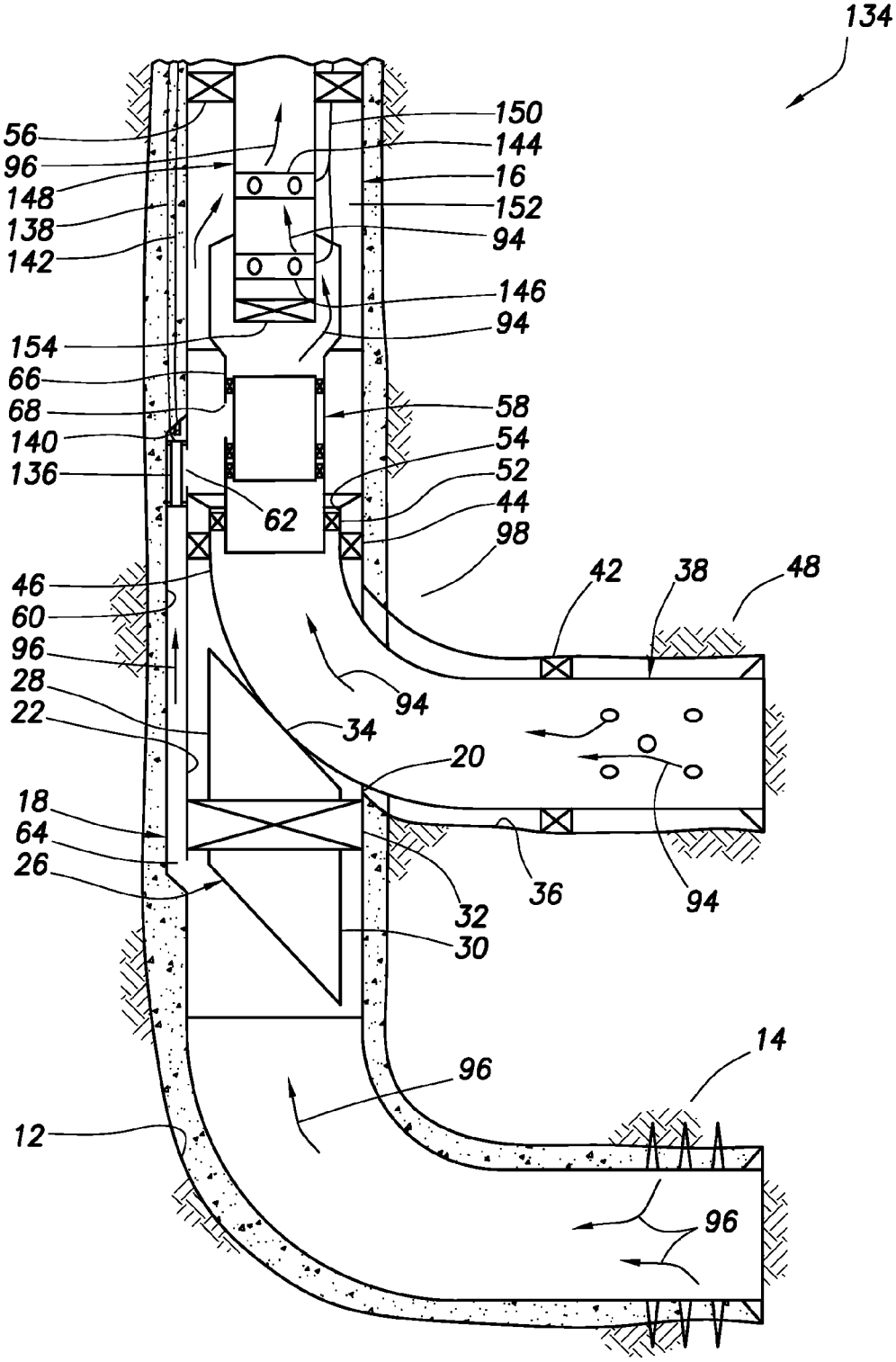
FIG. 12 is a schematic partially cross-sectional view of a second subterranean well system embodying principles of the present invention, including a fourth method of providing for fluid flow through the laterally offset passage of the wellbore junction.

Another method of selectively permitting and preventing fluid communication between the passages 22, 60 or fluid flow through the passage 60 is representatively illustrated in FIG. 12, which depicts another well system 134 similar in many respects to the system lo described above. Elements of the system 134 which are similar to those previously described are indicated in FIG. 12 using the same reference numbers.

As depicted in FIG. 12, a flow control device 136 is used in the system 134 to control fluid flow through the fluid path 62. The flow control device 136 is illustrated as a sliding sleeve-type valve, but it should be understood that any type of flow control device (such as other types of valves, chokes, etc.) may be used in keeping with the principles of the invention.

Preferably, operation of the flow control device 136 is controllable from a remote location, such as the earth's surface or another location in the well. For example, a control line 138 (such as a fiber optic, electric or hydraulic line) may extend between the flow control device 136 and the remote location. Alternatively, or in addition, the flow control device 136 could be remotely operated via telemetry, such as acoustic, electromagnetic, mud pulse, or other type of telemetry system.

A sensor 140 may be positioned to sense one or more parameters in the passage 60. These parameters may include temperature, pressure, composition, phase, water cut, or any other parameter. The sensor 140 may communicate with a remote location via a line 142 extending to the remote location, and/or any form of telemetry may be used. Other sensors (not shown) could be positioned to sense parameters in the passage 22 or elsewhere in the system 134 in keeping with the principles of the invention.

The system 134 also differs from the system 10 in that flow control devices 144, 146 are used to control fluid flow between each of the passages 22, 60 and the interior of a tubular string 148 engaged with the upper end 46 of the liner string 38. The flow control devices 144, 146 are preferably operated from a remote location via lines 150 extending between the flow control devices and the remote location. However, the flow control devices 144, 146 could be operated via telemetry or direct intervention into the well, without departing from the principles of the invention.

As depicted in FIG. 12, the fluid 96 flowing from the zone 14 passes through the passage 60, through the flow control device 136, and into an annulus 152 between the tubular string 148 and the casing string 16. The flow control device 144 selectively controls flow of the fluid 96 between the annulus 152 and the interior of the tubular string 148.

The fluid 94 flowing from the zone 48 passes through the passage 22 via the liner string 38 and into a lower end of the tubular string 148. A plug 154 isolates the lower end of the tubular string 148 from the interior of the tubular string above the plug. The flow control device 146 selectively controls flow of the fluid 94 between the lower end of the tubular string 148 and the interior of the tubular string above the plug 154.

The access and flow control device 58 as depicted in FIG. 12 has the sleeve 74 installed therein, which prevents fluid flow through the window 68. If access to the passage 60 is desired, the plug 154 and the sleeve 74 may be retrieved from within the tubular string 148. The flow control device 136 may not be used in the system 134 if access to the passage 60 is desired, or the flow control device could be opened to allow such access.

The liner string 38 as depicted in FIG. 12 has been modified somewhat to show an open hole completion in the branch wellbore 36. As described above, any of the wellbores 12, 36 may be completed in any manner in keeping with the principles of the invention.

Figure 13:
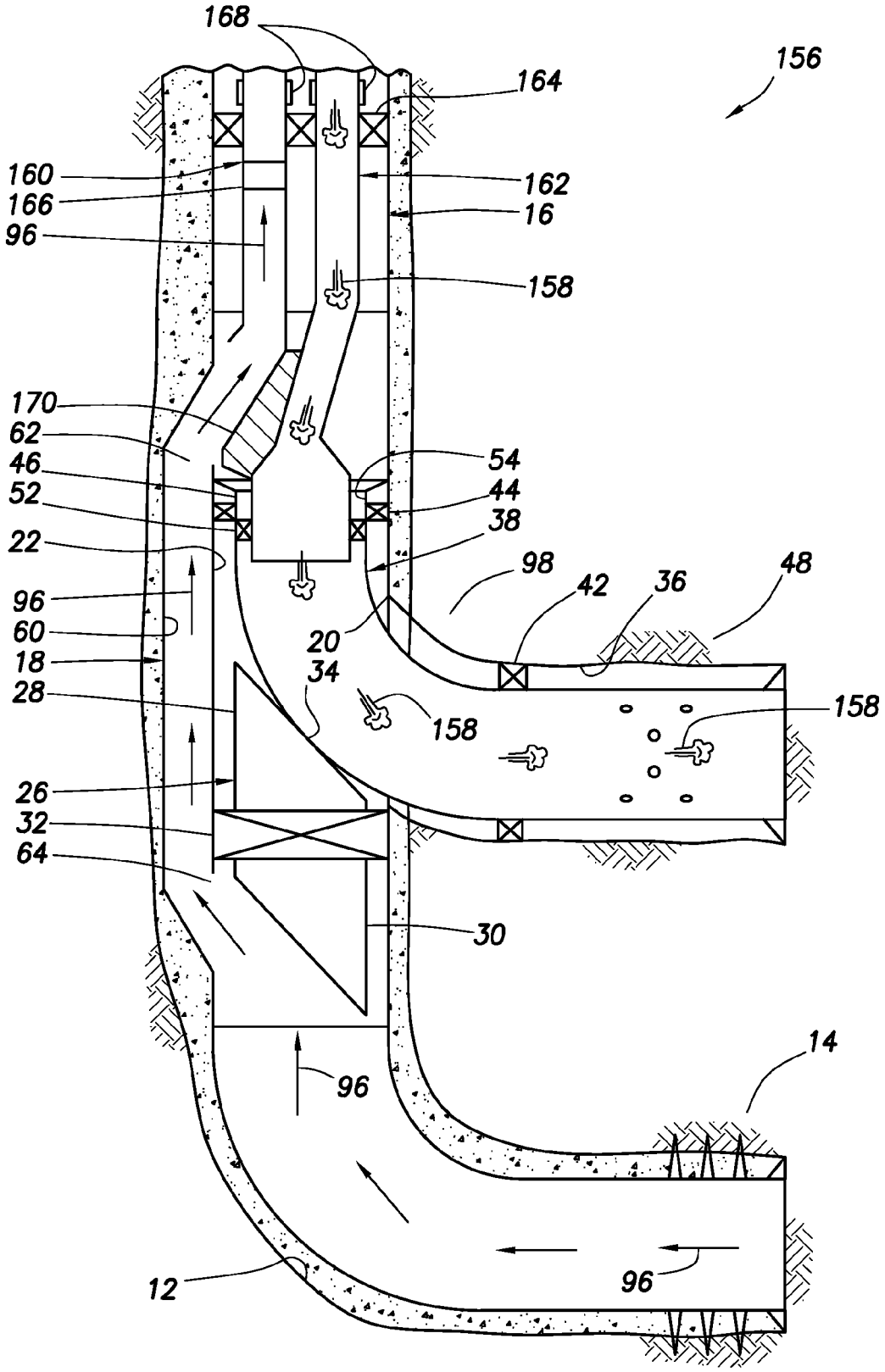
FIG. 13 is a schematic partially cross-sectional view of a third subterranean well system embodying principles of the present invention.

Referring additionally now to FIG. 13, another well system 156 is representatively illustrated. The system 156 is similar in many respects to the systems 10, 134 described above, and so elements of the system 156 which are similar to those previously described are indicated in FIG. 13 using the same reference numbers.

As described above, it is not necessary in keeping with the principles of the invention for fluids to be produced from the well. In the system 156, the fluid 96 is produced from the zone 14 as in the previously described systems 10, 134, but instead of producing the fluid 94 from the zone 48, steam 158 is injected into the zone 48. Also, instead of a single tubular string, two tubular strings 160, 162 are used. The fluid 96 is produced through the tubular string 160, and the steam 158 is injected through the other tubular string 162.

A dual string packer 164 secures and seals the tubular strings 160, 162 in the casing string 16. The tubular strings 160, 162 may also include additional equipment, such as an adjustable union 166 and travel joints 168. A deflector 170 may be attached to one or both of the tubular strings 160, 162 and rotationally oriented to deflect well tools, etc. from the tubular string 160 into the passage 60.

Figure 14:
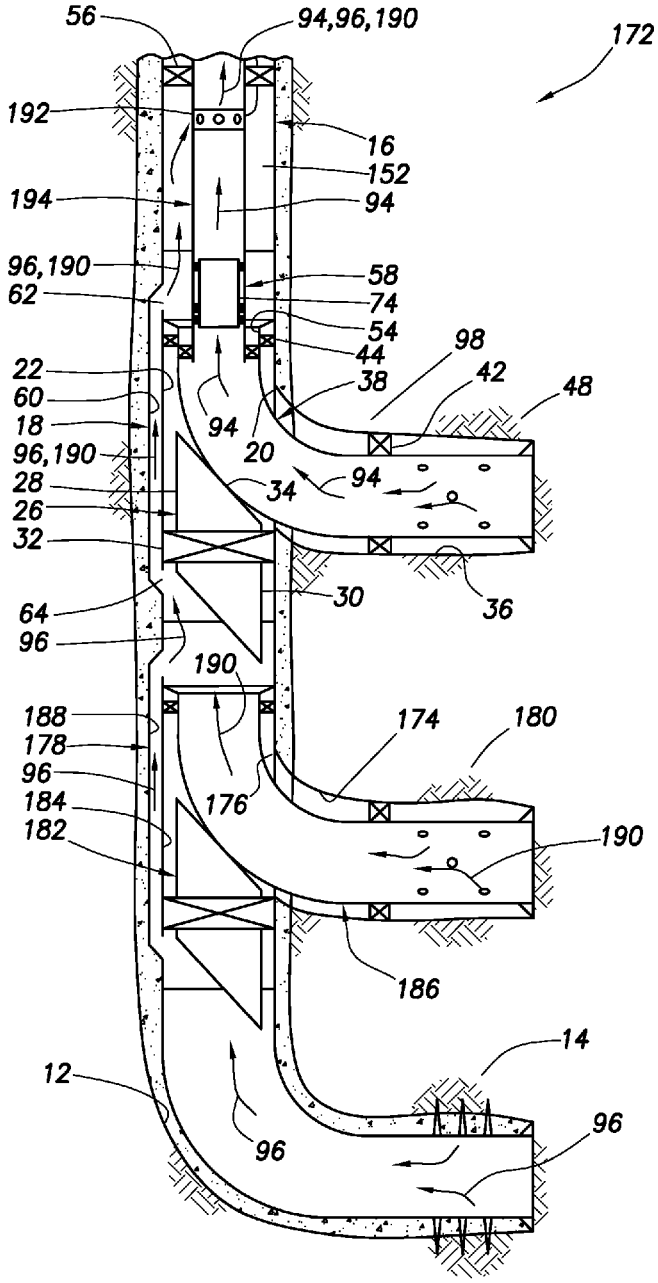
FIG. 14 is a schematic partially cross-sectional view of a fourth subterranean well system embodying principles of the present invention.

Referring additionally now to FIG. 14, another well system 172 is representatively illustrated. The system 172 is similar in many respects to the systems 10, 134, 156 described above, and so elements of the system 172 which are similar to those previously described are indicated in FIG. 14 using the same reference numbers.

The system 172 is used herein to demonstrate the benefits of the invention in completing wells which have multiple branch wellbores. As depicted in FIG. 14, an additional branch wellbore 174 has been drilled extending outwardly from a window 176 formed through a sidewall of another wellbore junction 178 interconnected in the casing string 16. The branch wellbore 174 intersects another formation or zone 180. Any number of branch wellbores may be used to intersect any number of formations or zones in keeping with the principles of the invention.

The wellbore junction 178 is installed and oriented, and the wellbore 174 is drilled and completed, as described above for the wellbore junction 18 and branch wellbore 36, respectively. A deflector assembly 182 is oriented and secured in a passage 184, and after drilling the wellbore 174, a liner string 186 is installed in the wellbore and an upper end of the liner string is secured in the passage. Another passage 188 in the wellbore junction 178 provides fluid communication between the passages 184, 188 above and below the deflector assembly 182 and the upper end of the liner string 186.

The fluid 96 flows from the zone 14, through the passage 188 and into a lower end of the upper wellbore junction 18. Thus, the deflector assembly 182 and upper end of the liner string 186 do not have to be retrieved from the well prior to producing the fluid 96.

Fluid (indicated by arrows 190) is produced from the zone 180 and flows through the liner string 186 and via the passage 184 into the lower end of the upper wellbore junction 18. Note that the fluids 96, 190 are commingled prior to, or while, the fluids enter the lower end of the upper wellbore junction 18. The commingled fluids 96, 190 flow through the passage 60 to the annulus 152 above the upper wellbore junction 18. A remotely operable flow control device 192 interconnected in a tubular string 194 engaged with the upper end of the liner string 38 controls flow of the fluids 96, 190 between the annulus 152 and the interior of the tubular string.

Figure 15:
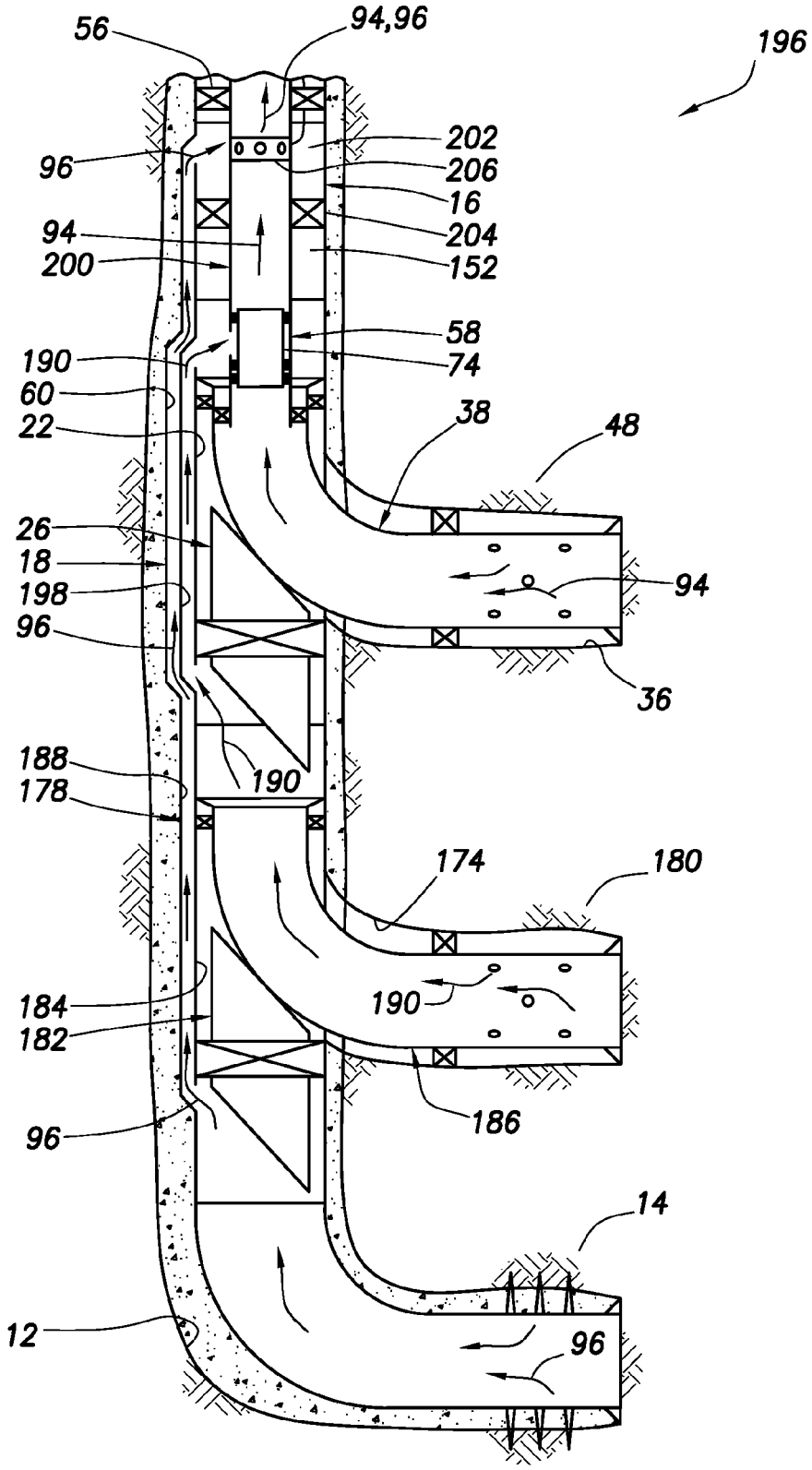
FIG. 15 is a schematic partially cross-sectional view of a fifth subterranean well system embodying principles of the present invention.

It may, in some circumstances, be desirable to prevent commingling of the fluids 96, 190 prior to flowing the fluids into the tubular string 194, for example, to permit independently controlled production of the fluids. Representatively illustrated in FIG. 15 is another well completion system 196 which permits independent control of production of the fluids 96, 190. In order to maintain segregation of the fluids 96, 190 as they flow through the upper wellbore junction 18, another passage 198 is provided in the wellbore junction.

The fluid 96 enters the passage 60 of the upper wellbore junction 18 from the passage 188 of the lower wellbore junction 178. The fluid 190 flows into the lower end of the upper wellbore junction 18 and enters the passage 198.

Although the passage 60 is shown schematically in FIG. 15 as being positioned outward from the passage 198, thereby causing the wellbore junction 18 to have an increased width, in actual practice the passages 60, 198 could be circumferentially distributed or otherwise positioned to more efficiently utilize the available area in the wellbore 12. For example, the passages 60, 198 could be formed in the housing 100 as depicted in FIG. 8.

The fluid 190 flows from the passage 198 into the annulus 152 between a tubular string 200 and the casing string 16. The fluid 96 flows from the passage 60 into another annulus 202 isolated from the annulus 152 by a packer 204.

Flow of the fluid 96 between the annulus 202 and the interior of the tubular string 200 is controlled by a remotely operable flow control device 206 interconnected in the tubular string. Flow of the fluid 190 between the annulus 152 and the interior of the tubular string 200 is prevented, as depicted in FIG. 15, by the sleeve 74 installed in the access and flow control device 58. If it is desired to permit the fluid 190 to enter the tubular string 200, the sleeve 74 may be retrieved from within the tubular string, the sleeve 74 may be replaced by the sleeve 70 depicted in FIG. 1, or the access and flow control device 58 may be replaced by the flow control device 78 depicted in FIG. 3 or by another of the flow control device 206.

Thus, it will be appreciated that the system 196 affords a wide variety of options for controlling the flow of the fluids 96, 190, while maintaining the advantages of the use of the wellbore junctions 18, 178. Note that the access and flow control device 58 also permits access, via the passage 198, to the branch wellbore 174.

Figure 16:
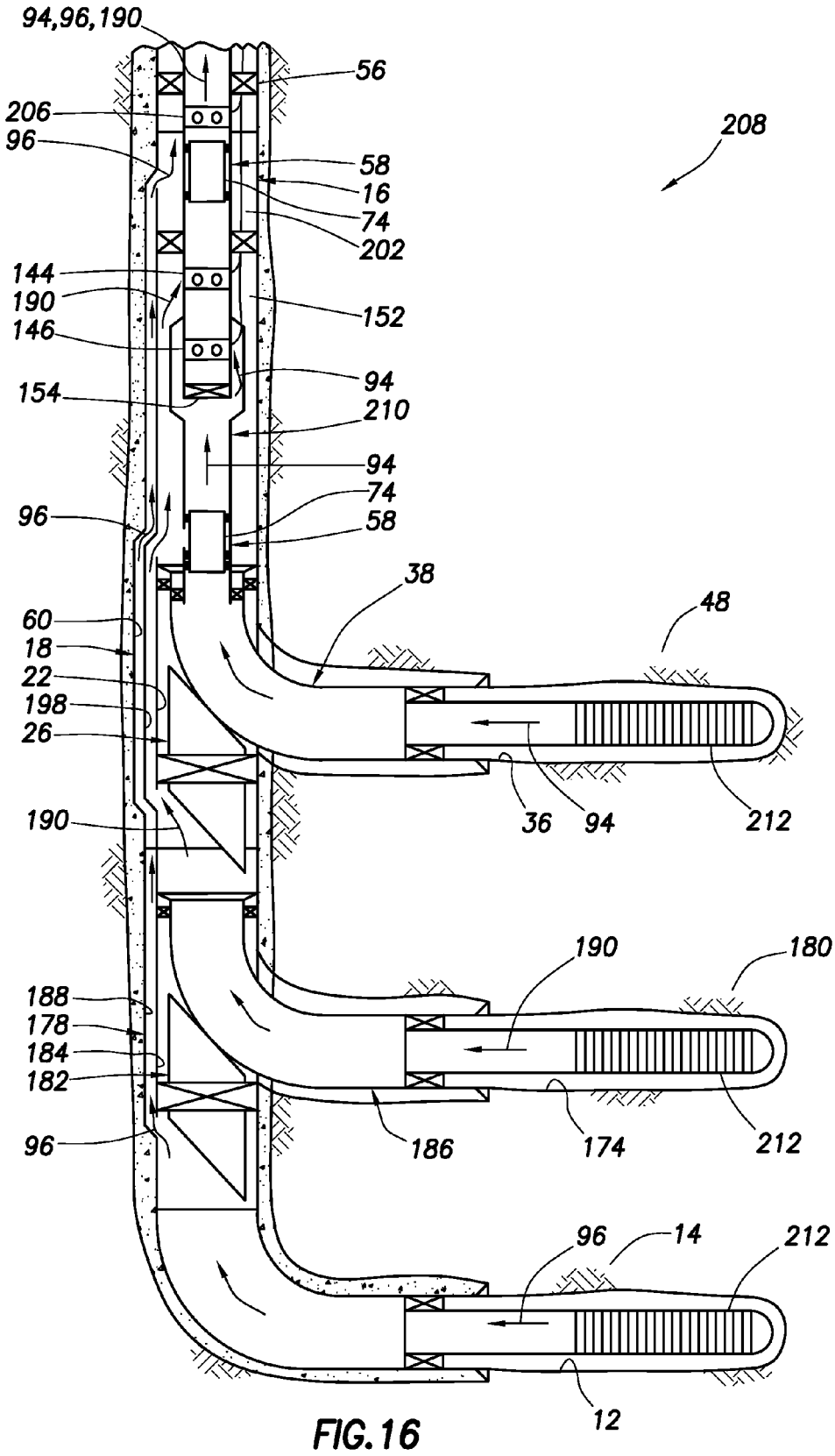
FIG. 16 is a schematic partially cross-sectional view of a sixth subterranean well system embodying principles of the present invention.

It may be desirable in some circumstances to permit access to both the branch wellbore 174 and the wellbore 12 below the wellbore junctions 18, 178, and also to be able to remotely control flow of each of the fluids 94, 96, 1go into a production tubing string. Representatively illustrated in FIG. 16 is another system 208 which accomplishes these objectives, and still does not require that either of the deflector assemblies 26, 182 or the upper ends of the liner strings 38, 186 be retrieved from the well.

A tubular string 210 engaged with the upper end of the liner string 38 includes the remotely operable flow control devices 144, 146, 206 for independently controlling flow of the fluids 190, 94, 96, respectively, into an interior of the tubular string. The tubular string 210 also includes two of the access and flow control devices 58. An upper one of the devices 58 is positioned opposite the passage 60 where it intersects the annulus 202, and a lower one of the devices is positioned opposite the passage 198 where it intersects the annulus 152.

To access the upper branch wellbore 36, the plug 154 is retrieved from the tubular string 210, and well tools, etc., can then be conveyed through the tubular string and into the liner string 38. To access the lower branch wellbore 174, the sleeve 74 in the lower device 58 is retrieved and replaced with the deflector 86 depicted in FIG. 4. Well tools, etc., can then be deflected out of the tubular string 210, into the passage 198, and then into the liner string 186. To access the main wellbore 12 below the wellbore junctions 18, 178, the sleeve 74 in the upper device 58 is retrieved and replaced with the deflector 86. Well tools, etc., can then be deflected out of the tubular string 210, into the passage 60, through the passage 188, and then into the wellbore 12 below the wellbore junctions 18, 178.

Note that the system 208 shows the wellbores 12, 36, 174 having been completed by installing slotted liners or screens 212 into open hole portions of the wellbores. Again, any of the wellbores 12, 36, 174 may be completed in any manner, without departing from the principles of the invention.

If the fluids 96, 190 are commingled between the wellbore junctions 18, 178, that is, if separate passages are not available for access to the lower branch wellbore 174 and the main wellbore 12 below the wellbore junctions (as in the system 172 depicted in FIG. 14), then it may be desirable to provide a means whereby well tools, etc., may be conveyed into a selected one of the lower branch wellbore 174 and the main wellbore 12 below the wellbore junctions. Representatively illustrated in FIG. 17 is a lower portion of the system 172, wherein an access control device 214 is used to provide such selective access to the lower branch wellbore 174 and the main wellbore 12 below the wellbore junctions 18, 178.

Figure 17:
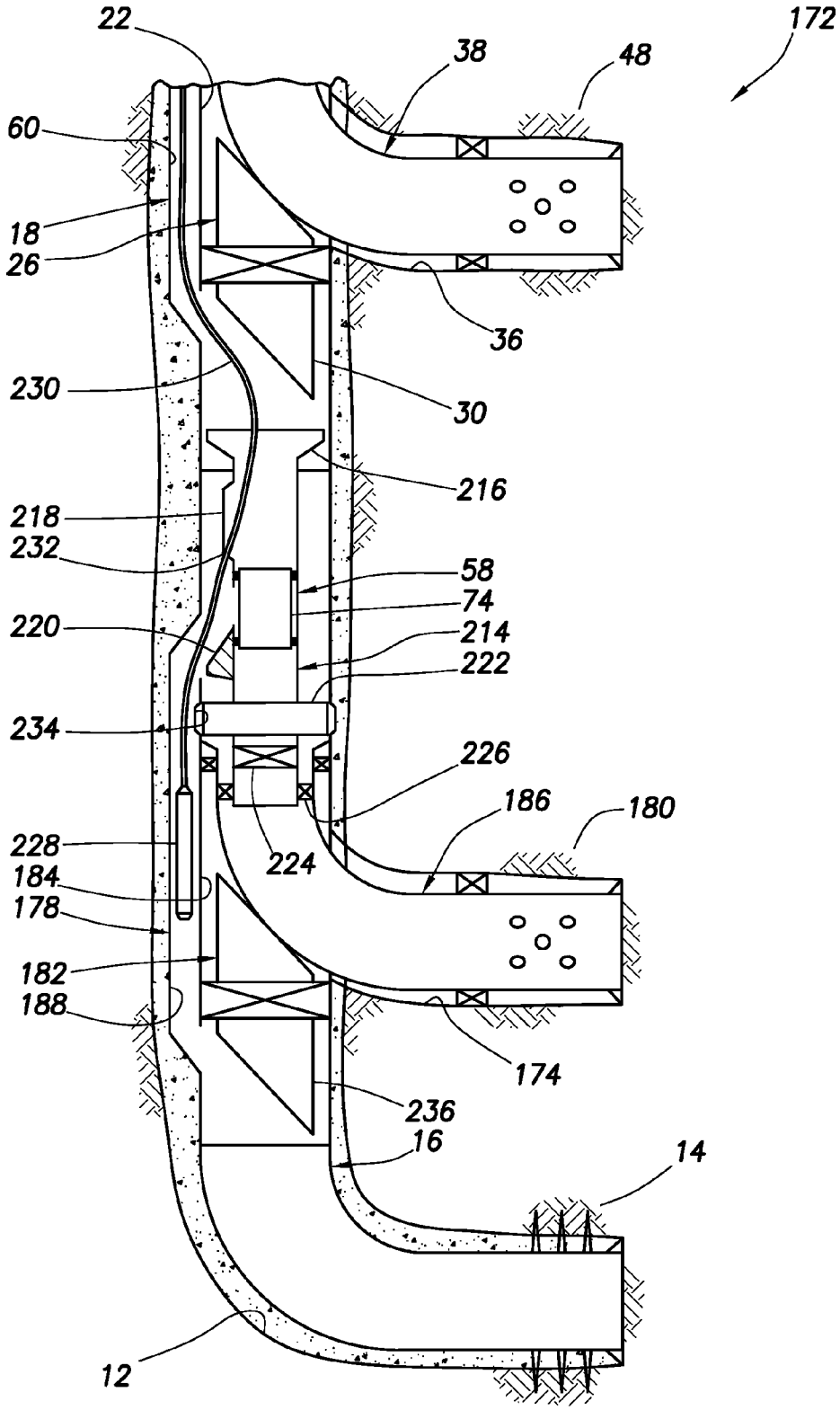
FIG. 17 is a schematic partially cross-sectional view of a seventh subterranean well system embodying principles of the present invention.

As depicted in FIG. 17, the access control device 214 includes a scoop head 216, a side pocket mandrel 218, an access and flow control device 58, a deflector 220, a latch 222, a plug 224 and seals 226. The scoop head 216 is used to funnel a well tool 228 conveyed, for example, by a coiled tubing string 230 through the passage 60, into the access control device 214. Upon entering the side pocket mandrel 218, a conventional kickover tool (not shown) may be used to divert the well tool 228 to pass through an opening 232 in a lower end of the side pocket. The deflector 220 then deflects the well tool 228 to enter the passage 188, which directs the well tool into the wellbore 12 below the lower wellbore junction 178.

In order to rotationally orient the opening 232 of the side pocket mandrel 218 and the deflector 220 to face toward the passage 188, the latch 222 preferably engages an orienting profile 234 formed in the passage 184. Engagement between the latch 222 and profile 234 secures the device 214 in the lower wellbore junction 178, with the seals 226 engaged in the upper end of the liner string 186. Of course, other types of sealing, securing and orienting devices may be used in keeping with the principles of the invention.

As an alternative, or in addition, to the side pocket mandrel 218 and deflector 220, the device 58 may be used to permit access between the interior of the access control device 214 and the passage 188. For example, the sleeve 74 may be replaced with the deflector 86 depicted in FIG. 4, to thereby deflect the well tool 228 into the passage 188. If access to the wellbore 174 is desired, the plug 224 may be retrieved, permitting the well tool 228 to pass straight through the device 214 and into the liner string 186.

Note that the lower deflector 30 of the upper deflector assembly 26 aids reentry of the well tool 228 into the passage 60, and a lower deflector 236 of the lower deflector assembly 182 aids reentry of the well tool into the passage 188, when the well tool is eventually retrieved from the well.

The access control device 214 may be installed in the casing string 16 along with the wellbore junctions 18, 178 as the casing string is being installed in the main wellbore 12. Alternatively, the device 214 may be reduced in size from that shown in FIG. 17 and conveyed (such as by wireline or coiled tubing) through the casing string 16, through the passage 60, and engaged in the lower wellbore junction 178 after the casing string is installed. Thus, the device 214 could be installed only when it is desired to selectively access the wellbore 174 or the wellbore 12 below the wellbore junctions 18, 178.

In the illustrations accompanying the above description, the passage 60 has been shown as being external to the tubular housing 102 through which the passage 22 extends. It should be clearly understood that many other configurations are possible in keeping with the principles of the invention. Representatively illustrated in FIG. 18 is a cross-sectional view of another configuration of the wellbore junction 18 in which the semicircular housing 100 is attached internally to the housing 102, so that the passage 60 is formed between the housings 100, 102.

Note that the passages 22, 60 are still separated by only the single layer of material 116. In addition, if the housing 102 has the same dimensions as the adjacent casing string 16 (or at least is not substantially larger than the adjacent casing string), then the wellbore junction 18 can be conveniently installed without the need for expanding either of the passages 22, 60 downhole. However, if desired, either or both of the passages 22, 60 could be expanded downhole in keeping with the principles of the invention.

Figure 19:
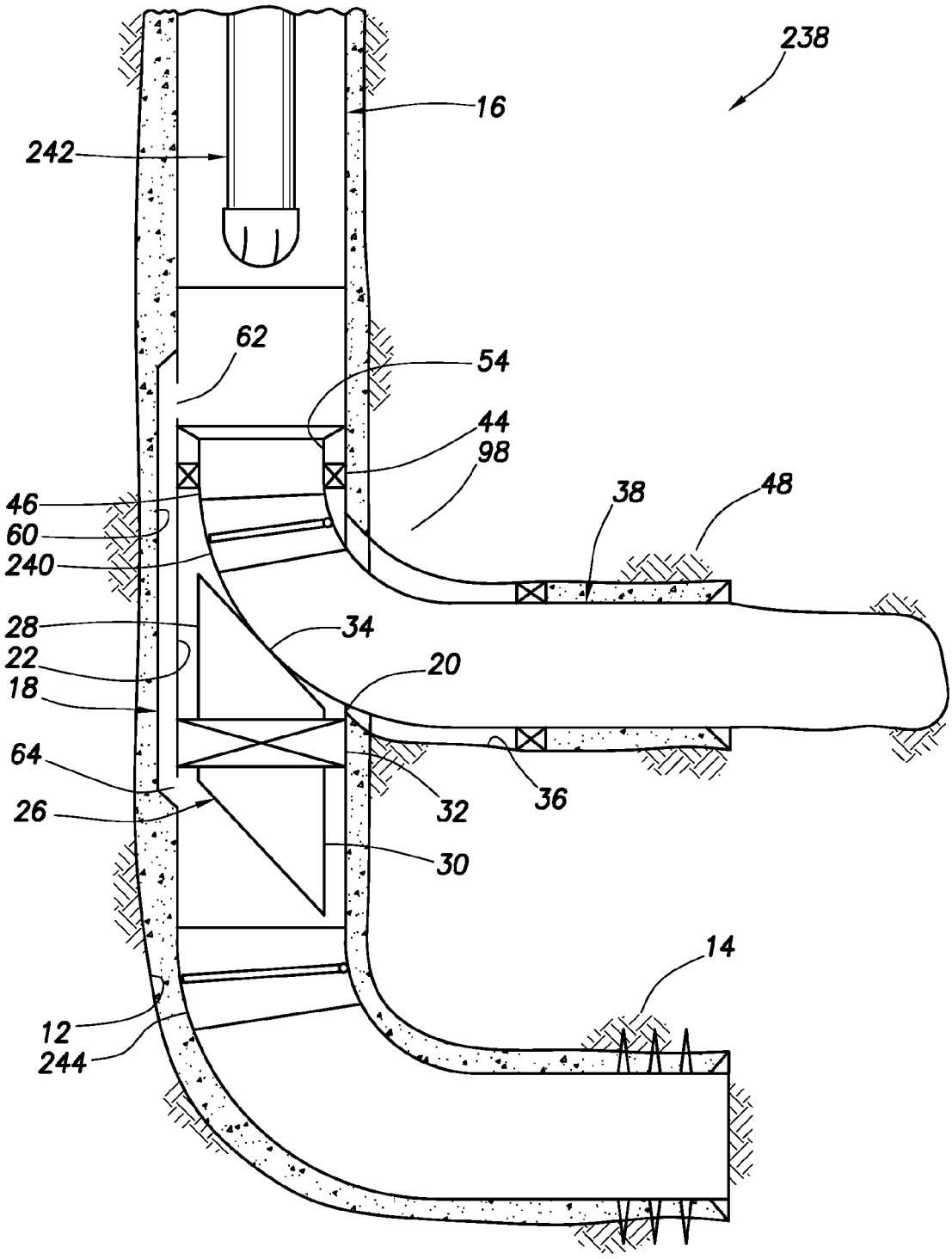
FIG. 19 is a schematic partially cross-sectional view of an eighth subterranean well system embodying principles of the present invention.

Referring additionally now to FIG. 19, another system 238 embodying principles of the present invention is representatively illustrated. The system 238 is similar in many respects to the system 134 described above, and so elements illustrated in FIG. 19 which are similar to those described above are indicated using the same reference numbers.

It may be desirable in some circumstances to be able to drill the branch wellbore 36 in an underbalanced condition. That is, the pressure in the wellbore 36 is less than pore pressure in the formation 48 during the drilling operation. For example, underbalanced drilling may be useful to prevent fluid loss into the formation 48, or to prevent damage to the formation from exposure to drilling fluid solids, etc.

In order to provide for such underbalanced drilling of the branch wellbore 36, the liner string 38 in the system 238 is equipped with a fluid loss control device 240. The device 240 is preferably a valve which permits a drill string 242 to be tripped in and out of the branch wellbore 36 while the wellbore is in an underbalanced condition, and without a need for killing the well or snubbing the drill string out of the well under pressure.

An acceptable fluid loss control device is the Quick Trip Valve available from Halliburton Energy Services, Inc. of Houston, Tex. This Quick Trip Valve is opened by the drill string 242 as it is lowered through the valve, and is closed as the drill string is retrieved through the valve. However, any fluid loss control device may be used in keeping with the principles of the invention.

The fluid loss control device 240 is preferably positioned in the liner string 38 below the liner hanger packer 44 in the passage 22 of the wellbore junction 18. This positioning provides convenient access to the device 240 in the main wellbore 12. However, other positions may be used for the device 240 in keeping with the principles of the invention.

Note that another fluid loss control device 244 may be used in the casing string 16 below the wellbore junction 18 if it is desired to drill the lower main wellbore 12 in an underbalanced condition. The device 244 may be the same as, or different from, the device 240.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A wellbore junction for use in a subterranean well, the wellbore junction comprising:

a first passage extending from a first opposite end to a second opposite end of the wellbore junction;

a window formed through a sidewall of the wellbore junction; and a second passage in communication with the first passage on a first side of the window, and in communication with the first passage on a second side of the window, wherein the wellbore junction including the first and second passages is interconnected in a casing string as the casing string is run-in and installed in the well, the first passage thereby forming a portion of a bore of the casing string.

2. The wellbore junction according to claim 1, wherein the second passage is generally parallel to the first passage in the wellbore junction.

3. The wellbore junction according to claim 1, wherein the second passage is laterally offset relative to a longitudinal axis of the first passage.

4. The wellbore junction according to claim 1, wherein the second passage is separated from the first passage by only a single layer of material.

5. The wellbore junction according to claim 4, wherein the wellbore junction sidewall includes the layer of material.

6. The wellbore junction according to claim 1, wherein the second passage is positioned external to a tubular cylindrical structure containing the first passage.

7. The wellbore junction according to claim 1, wherein the second passage is positioned internal to a tubular cylindrical structure containing the first passage.

8. The wellbore junction according to claim 1, wherein the first passage is expanded in the well to an enlarged configuration.

9. The wellbore junction according to claim 1, wherein the second passage is expanded in the well to an enlarged configuration.

10. The wellbore junction according to claim 1, further comprising a liner string extending through the window and secured in the first passage between the window and a fluid path providing fluid communication between the first and second passages.

11. A subterranean well system, comprising:

a wellbore junction positioned in a first wellbore at an intersection between the first wellbore and a second wellbore, the wellbore junction having first and second passages formed therein, the first passage extending through the wellbore junction; and a liner string extending outwardly through a window formed through a sidewall of the wellbore junction and having an end secured in the first passage, the liner string extending into the second wellbore, wherein the second passage provides fluid communication between the first passage on a first side of the liner string end and the first passage on a second side of the liner string end, and wherein the wellbore junction including the first and second passages is interconnected in a casing string as the casing string is run-in and installed in the first wellbore, so that the first passage forms a portion of a bore of the casing string.

12. The system according to claim 11, further comprising a well tool conveyed through the second passage from the first passage on the first side of the liner string end to the first passage on the second side of the liner string end.

13. The system according to claim 11, further comprising a tubular string extending through the second passage between the first side of the liner string end and the second side of the liner string end.

14. The system according to claim 11, wherein the first passage is aligned with a longitudinal axis of the casing string.

15. The system according to claim 11, wherein at least first and second deflectors are secured in the casing string below the liner string end.

16. The system according to claim 11, further comprising multiple of the wellbore junctions interconnected in the casing string.

17. The system according to claim 16, wherein each of the wellbore junctions has a deflector secured in the first passage.

18. The system according to claim 16, further comprising a tubular string positioned in the casing string, and wherein fluid flow between the second passage of each wellbore junction and the tubular string is controlled by a respective one of multiple flow control devices.

19. The system according to claim 18, wherein the tubular string is sealingly engaged with the liner string end in the first passage.

20. The system according to claim 18, wherein the flow control devices are remotely controllable.

21. The system according to claim 18, wherein the flow control devices are interconnected in the tubular string.

22. The system according to claim 11, wherein a first deflector is secured in the first passage for deflecting the liner string through the window.

23. The system according to claim 22, wherein the second passage provides fluid communication between the first passage on a first side of the first deflector and the first passage on a second side of the first deflector.

24. The system according to claim 22, wherein a second deflector is secured in the casing string below the wellbore junction.

25. The system according to claim 11, wherein the wellbore junction is expanded in the first wellbore.

26. The system according to claim 11, wherein the first passage is expanded in the first wellbore.

27. The system according to claim 11, wherein the second passage is expanded in the first wellbore.

28. The system according to claim 11, wherein the first passage extends through a tubular cylindrical structure.

29. The system according to claim 28, wherein the second passage is positioned external to the structure.

30. The system according to claim 28, wherein the second passage is positioned internal to the structure.

31. The system according to claim 28, wherein the second passage is separated from the first passage by a sidewall of the structure.

32. The system according to claim 28, wherein the second passage is separated from the first passage by only a single layer of material in the structure sidewall.

33. The system according to claim 11, wherein the first wellbore is a branch wellbore.

34. The system according to claim 11, further comprising a flow control device which controls fluid flow between the first and second passages.

35. The system according to claim 11, further comprising an access control device interconnected in a tubular string engaged with the liner string end, the access control device controlling access between the second passage and an interior of the tubular string.

36. The system according to claim 35, wherein the access control device includes a sleeve movable relative to an opening formed through a sidewall of the tubular string.

37. The system according to claim 35, wherein the access control device further controls fluid flow between the second passage and the interior of the tubular string.

38. The system according to claim 11, wherein a first fluid is produced from the well via one of the first and second passages while a second fluid is injected into the well via the other of the first and second passages.

39. The system according to claim 11, further comprising a sensor sensing a fluid property in the second passage.

40. The system according to claim 11, further comprising a flow control device in the second passage controlling fluid flow between the first and second passages.

41. The system according to claim 40, wherein operation of the flow control device is controlled from a remote location.

42. The system according to claim 11, further comprising a third passage of the wellbore junction, the third passage providing fluid communication between the casing string on a first side of the wellbore junction and the casing string on a second side of the wellbore junction.

43. The system according to claim 42, wherein the third passage is in fluid communication with an interior of the casing string below another wellbore junction interconnected in the casing string.

44. The system according to claim 43, wherein the third passage is further in fluid communication with another liner string secured in the another wellbore junction and extending into a third wellbore.

45. The system according to claim 43, wherein the third passage is isolated from fluid communication with another liner string secured in the another wellbore junction and extending into a third wellbore.

46. The system according to claim 11, wherein the first wellbore intersects a third wellbore, and wherein the second passage provides fluid communication between the third wellbore and a casing string attached above the wellbore junction.

47. The system according to claim 46, wherein a deflector assembly secured in the first passage prevents fluid communication through the first passage between the third wellbore and the casing string above the wellbore junction.

48. The system according to claim 11, wherein the liner string end is secured in the first passage between the window and a first fluid path providing fluid communication between the first and second passages.

49. The system according to claim 48, further comprising a deflector secured in the first passage between the liner string end and a second fluid path providing fluid communication between the first and second passages.

50. The system according to claim 11, wherein the first and second passages extend generally parallel to each other in the wellbore junction.

51. The system according to claim 11, further comprising a fluid loss control device selectively permitting and preventing fluid flow between the first and second wellbores.

52. The system according to claim 51, wherein the fluid loss control device is interconnected in the liner string below a liner hanger which secures the liner string to the wellbore junction.

53. The system according to claim 51, wherein the fluid loss control device is positioned in the wellbore junction first passage.

54. A method of completing a well having at least first and second intersecting wellbores, the method comprising the steps of:

installing a casing string in the first wellbore, including interconnecting a first wellbore junction in the casing string;

securing a first deflector assembly in a first passage of the first wellbore junction; and flowing fluid through a second passage of the first wellbore junction between the casing string on a first side of the first wellbore junction and the casing string on a second side of the first wellbore junction, without retrieving the first deflector assembly from the first passage, and wherein in the installing step the first wellbore junction including the first and second passages is interconnected in the casing string as the casing string is being run-in and installed in the first wellbore.

55. The method according to claim 54, further comprising the steps of:

deflecting a first liner string off of the first deflector assembly and into the second wellbore; and securing an end of the first liner string in the first passage.

56. The method according to claim 55, wherein the securing step is performed prior to the flowing step.

57. The method according to claim 55, further comprising the steps of:

conveying a tubular string through the casing string;

engaging the tubular string with the end of the first liner string, thereby providing fluid communication between the first liner string and the tubular string; and providing fluid communication between the tubular string and the second passage of the first wellbore junction.

58. The method according to claim 57, wherein the step of providing fluid communication between the tubular string and the second passage of the first wellbore junction comprises interconnecting a first flow control device in the tubular string.

59. The method according to claim 58, further comprising the step of operating the first flow control device from a remote location.

60. The method according to claim 58, wherein the step of providing fluid communication between the first liner string and the tubular string comprises interconnecting a second flow control device in the tubular string.

61. The method according to claim 60, further comprising the step of deflecting a second liner string off of a second deflector assembly installed in a first passage formed through a second wellbore junction interconnected in the casing string, the second liner string being deflected into a third wellbore intersecting the first wellbore.

62. The method according to claim 61, further comprising the step of providing fluid communication between the second liner string and the tubular string.

63. The method according to claim 62, wherein the step of providing fluid communication between the second liner string and the tubular string comprises interconnecting a second flow control device in the tubular string.

64. The method according to claim 63, further comprising the step of operating the second flow control device from a remote location.

65. The method according to claim 62, wherein the step of providing fluid communication between the second liner string and the tubular string comprises flowing fluid through a third passage of the first wellbore junction.

66. The method according to claim 62, wherein the step of providing fluid communication between the second liner string and the tubular string comprises flowing fluid through a second passage of the second wellbore junction between the casing string on a first side of the second wellbore junction and the casing string on a second side of the second wellbore junction, without retrieving the second deflector assembly from the first passage of the second wellbore junction.

67. The method according to claim 57, wherein the step of providing fluid communication between the tubular string and the second passage of the first wellbore junction comprises interconnecting a flow control device in the second passage of the first wellbore junction, the flow control device controlling fluid flow between the first and second passages of the first wellbore junction.

68. A method of completing a well having at least first and second intersecting wellbores, the method comprising the steps of:

installing a casing string in the first wellbore, including interconnecting a first wellbore junction in the casing string;

securing a first deflector assembly in a first passage of the first wellbore junction;

deflecting a first liner string off of the first deflector assembly and into the second wellbore;

securing an end of the first liner string in the first passage;

flowing fluid through a second passage of the first wellbore junction between the casing string on a first side of the first wellbore junction and the casing string on a second side of the first wellbore junction, without retrieving the first deflector assembly from the first passage;

conveying a tubular string through the casing string;

engaging the tubular string with the end of the first liner string, thereby providing fluid communication between the first liner string and the tubular string;

providing fluid communication between the tubular string and the second passage of the first wellbore junction; and conveying a well tool through the tubular string and into the second passage of the wellbore junction.

69. The method according to claim 68, wherein the well tool conveying step further comprises conveying a coiled tubing string through the tubular string and into the second passage.

70. The method according to claim 68, wherein the well tool conveying step further comprises conveying a wireline through the tubular string and into the second passage.

71. The method according to claim 68, wherein the well tool conveying step further comprises conveying the well tool into the casing string below the wellbore junction.

72. The method according to claim 68, wherein the well tool conveying step further comprises conveying the well tool into a third wellbore intersected by the first wellbore.

73. The method according to claim 68, wherein the well tool conveying step further comprises installing a second deflector assembly in the tubular string, and deflecting the well tool into the second passage through a window formed in a sidewall of the tubular string.

74. The method according to claim 54, further comprising the step of expanding the first passage in the well.

75. The method according to claim 54, further comprising the step of expanding the second passage in the well.

76. The method according to claim 54, further comprising the step of, after installing the casing string in the first wellbore, forming a fluid path between the first and second passages.

77. The method according to claim 76, wherein the forming step is performed by a cutting tool conveyed into the first wellbore junction.

78. The method according to claim 77, wherein the forming step further comprises deflecting the cutting tool from within the first passage to cut through a layer of material separating the first and second passages.

79. The method according to claim 76, wherein the forming step is performed by a perforator conveyed into the first wellbore junction.

80. The method according to claim 54, further comprising the step of, after installing the casing string in the first wellbore, permitting fluid communication between the first and second passages.

81. The method according to claim 80, wherein the fluid communication permitting step is performed by opening a flow control device of the wellbore junction.

82. The method according to claim 54, further comprising the step of, after installing the casing string in the first wellbore, permitting fluid flow through the second passage.

83. The method according to claim 82, wherein the fluid flow permitting step further comprises retrieving a plug from the second passage.

84. The method according to claim 54, further comprising the step of installing a fluid loss control device in the well, the fluid loss control device selectively permitting and preventing fluid flow between the first and second wellbores.

85. The method according to claim 84, wherein the fluid loss control device installing step further comprises interconnecting the fluid loss control device in a liner string extending from the first wellbore junction and into the second wellbore.

86. The method according to claim 85, wherein the interconnecting step further comprises interconnecting the fluid loss control device below a liner hanger which secures the liner string to the first wellbore junction.

87. The method according to claim 84, wherein the fluid loss control device installing step further comprises positioning the fluid loss control device in the first wellbore junction first passage.

88. Apparatus f or use in a subterranean wellbore, the apparatus comprising:

a portion of a casing string, a longitudinal bore of the casing string extending through the casing string portion, and the casing string portion further including a flow passage at least partially separated from the bore and providing fluid communication between first and second longitudinally separated portions of the bore in the casing string portion, and wherein the casing string portion, including the first and second portions of the bore, is interconnected in the casing string as the casing string is run-in and installed in the wellbore.

89. The apparatus of claim 88, further comprising a plug positioned in the bore and preventing fluid communication through the bore between the first and second bore portions.

90. The apparatus of claim 88, wherein the flow passage permits fluid communication between the first and second bore portions while fluid communication is prevented through the bore between the first and second bore portions.

91. The apparatus of claim 88, further comprising a sensor sensing a parameter of fluid in the flow passage.

92. The apparatus of claim 91, further comprising a line extending between the sensor and a remote location.

93. The apparatus of claim 92, wherein the line extends external to the casing string portion.

94. The apparatus of claim 88, further comprising a flow control device selectively permitting and preventing fluid flow through the flow passage.

95. The apparatus of claim 94, wherein the flow control device is a safety valve.

96. The apparatus of claim 94, further comprising a line extending between the flow control device and a remote location.

97. The apparatus of claim 96, wherein the line extends external to the casing string portion.

98. The apparatus of claim 88, further comprising a line extending between the flow passage and a remote location.

99. The apparatus of claim 98, wherein the line extends external to the casing string portion.

100. The apparatus of claim 88, wherein the casing string portion includes multiple ones of the flow passage.

101. The apparatus of claim 88, wherein the casing string portion further includes a window formed through a sidewall of the casing string portion.

102. The apparatus of claim 101, wherein the casing string portion is positioned in a first wellbore, and wherein the window provides access between the bore and a second wellbore intersecting the first wellbore.

* * * * *